US006060942A

United States Patent [19]

Oh

[11] Patent Number: 6,060,942

[45] Date of Patent: May 9, 2000

[54] VOLTAGE BOOSTING POWER SUPPLY CIRCUIT OF MEMORY INTEGRATED CIRCUIT AND METHOD FOR CONTROLLING CHARGE AMOUNT OF VOLTAGE BOOSTING POWER SUPPLY

[75] Inventor: Seung-cheol Oh, Kyungki-do, Rep. of Korea

[73] Assignee: Samsung Electronics, Co., Ltd., Suwon-city, Rep. of Korea

[21] Appl. No.: 09/064,698

[22] Filed: Apr. 22, 1998

[30] Foreign Application Priority Data

Apr. 22, 1997 [KR] Rep. of Korea ..... 97-15003

[51] Int. Cl.[7] ..... G05F 1/10

[52] U.S. Cl. ..... 327/536; 327/525; 365/226

[58] Field of Search ..... 327/536, 538, 327/540, 541, 525, 589; 363/59, 60; 365/226

[56] References Cited

U.S. PATENT DOCUMENTS

| | | | |
|---|---|---|---|
| 4,695,745 | 9/1987 | Mimoto et al. | 307/297 |
| 5,315,557 | 5/1994 | Kim et al. | 365/222 |
| 5,448,199 | 9/1995 | Park | 327/525 |
| 5,909,142 | 6/1999 | Kawasaki et al. | 327/525 |

FOREIGN PATENT DOCUMENTS 95-24215 1/1994 Rep. of Korea .

*Primary Examiner*—Timothy P. Callahan
*Assistant Examiner*—Jung Ho Kim
*Attorney, Agent, or Firm*—Marger Johnson & McCollom, P.C.

[57] ABSTRACT

A voltage boosting power supply circuit of a memory integrated circuit and a method for controlling charge amount of a voltage boosting power supply. The voltage boosting power supply circuit includes first and second power suppliers, first and second fuses, a voltage boosting controller, a voltage boosting enabling unit, and a voltage booster. The first and second power suppliers supply power supply. Each of one ends of the first and second fuses is connected to the first and second power suppliers. The voltage boosting controller generates first and second control signals a voltage boosting controller for generating first and second control signals, responding to a voltage boosting control signal which is in a ground voltage state before signals generated from each of other ends of the first and second fuses and the power supply become stable, and becomes logic high when the power supply becomes stable. The voltage boosting enabling unit generates the third to fifth control signals, responding to the first and second control signals and the voltage boosting enable signal. The voltage booster generates the voltage boosting power supply, responding to the third to fifth control signals.

20 Claims, 8 Drawing Sheets

VOLTAGE BOOSTING POWER SUPPLY CIRCUIT OF MEMORY INTEGRATED CIRCUIT AND METHOD FOR CONTROLLING CHARGE AMOUNT OF VOLTAGE BOOSTING POWER SUPPLY

BACKGROUND OF THE INVENTION

1. Field of the Invention

The present invention relates to a memory integrated circuit, and more particularly, to a voltage boosting power supply circuit for regulating the charge amount supplied to a memory circuit.

The present application is based on Korean Patent Application No. 97-15003 which is incorporated herein by reference for all purposes.

2. Description of the Related Art

In general, as the capacitance in memory integrated circuits increases, the need for supplying a voltage boosting power supply to the memory circuits for activating word lines in the memory cells increases.

FIG. 1 is a circuit diagram of a conventional voltage boosting power supply circuit for a memory integrated circuit. Referring to FIG. 1, the conventional voltage power supply circuit includes a buffer 11, a voltage booster 13 and a transmitter 15. The voltage booster 13 includes an NMOS transistor 31 and three capacitors 21, 23 and 25, where capacitor 21 is deactivated and capacitors 23,35 are coupled in parallel between buffer 11 and transmitter 15.

When the charge amount of the conventional voltage boosting power supply is more than that consumed in the output terminal of the transmitter, the reliability of the memory integrated circuit chip may malfunction. Similarly, when the charge amount of the voltage boosting power supply of the voltage booster is less than that consumed in the output of the transmitter, the memory integrated circuit chip is reduced. Accordingly, it is desired to adjust the charge supplied by the voltage boosting power supply to closely match the charge consumed.

FIG. 2A shows an alteration of the circuit of FIG. 1 for reducing the charge amount of a voltage boosting power supply Vpp. FIG. 2B shows another alteration of the circuit of FIG. 1 for increasing the charge amount of the voltage boosting power supply Vpp.

Comparing FIGS. 2A and 2B, the amount of charge from the voltage boosting power supply is reduced or increased depending upon the connection state of input and output terminals of the capacitors 21 and 25. Changing the connection states of the metal lines leads of the capacitors 21,25 requires that the masking process and lithography process be re-performed. Doing so, however, requires great cost and delays development of the integrated circuit chip.

Accordingly, the need remains for a more efficient method and structure for controlling such charge amount.

SUMMARY OF THE INVENTION

It is, therefore, an object of the present invention to provide a voltage boosting power supply circuit of a memory integrated circuit capable of controlling the charge amount of a voltage boosting power supply in a wafer state without re-performing a masking process and lithography process.

It is another object of the present invention to provide a method for controlling the charge amount of the voltage boosting power supply in a wafer state.

To achieve the above object of the present invention, the circuit includes first and second power suppliers, first and second fuses, a voltage boosting controller, a voltage boosting enabling unit, and a voltage booster. The first and second fuses are coupled between respective first and second power suppliers and the voltage boosting controller.

The voltage boosting controller generates first and second control signals, responsive to a voltage boosting control signal. The control signal is initially and becomes logic high when the first and second power supplies becomes stable.

To accomplish another object of the present invention, there is provided a method for controlling charge amount of a voltage boosting power supply of a memory integrated circuit having first and second fuses, a voltage booster connected to the first and second fuses for supplying a voltage boosting power supply, and a load connected to the voltage booster for consuming charge of the voltage boosting power supply. The charge amount supplied from the voltage boosting power supply increases when the first fuse is cut, and the charge amount of the supplied voltage boosting power supply is reduced when the second fuse is cut.

The method comprises the steps of first turning on the power of the memory integrated circuit. The charge amount of the supplied voltage boosting power supply is compared to that of the consumed voltage boosting power supply. The first fuse is cut when the charge amount of the supplied voltage boosting power supply is less than the charge amount of the consumed voltage boosting power supply. The second fuse is cut when the charge amount of the supplied voltage boosting power supply is more than the charge amount of the consumed voltage boosting power supply.

According to the present invention, great production cost of an integrated circuit chip is reduced, and development of the integrated circuit chip is not delayed.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

Figure 1:
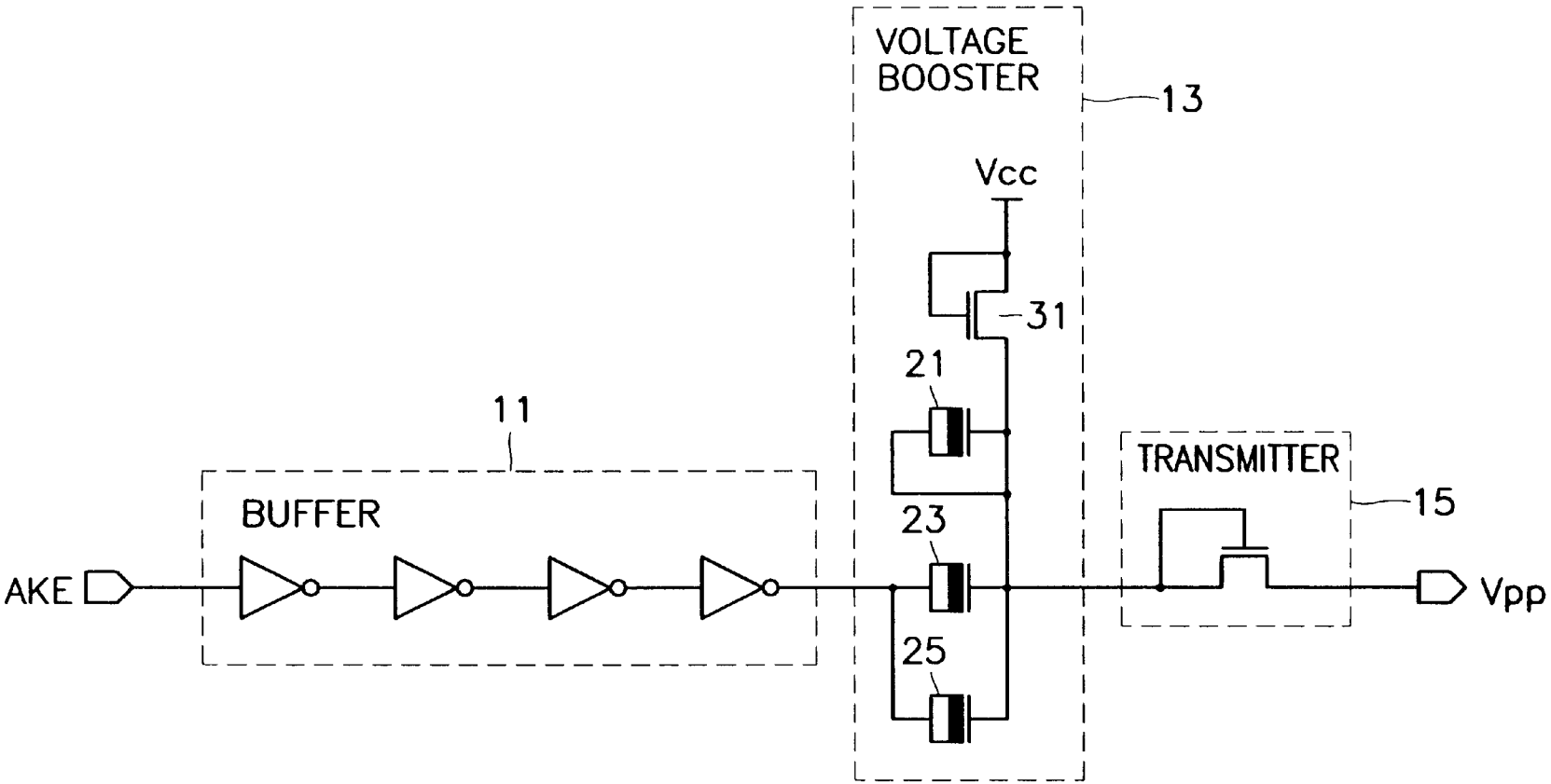
FIG. 1 (PRIOR ART)
FIG. 1 is a circuit diagram of a conventional voltage boosting power supply circuit of a memory integrated circuit.
Figure 2A:
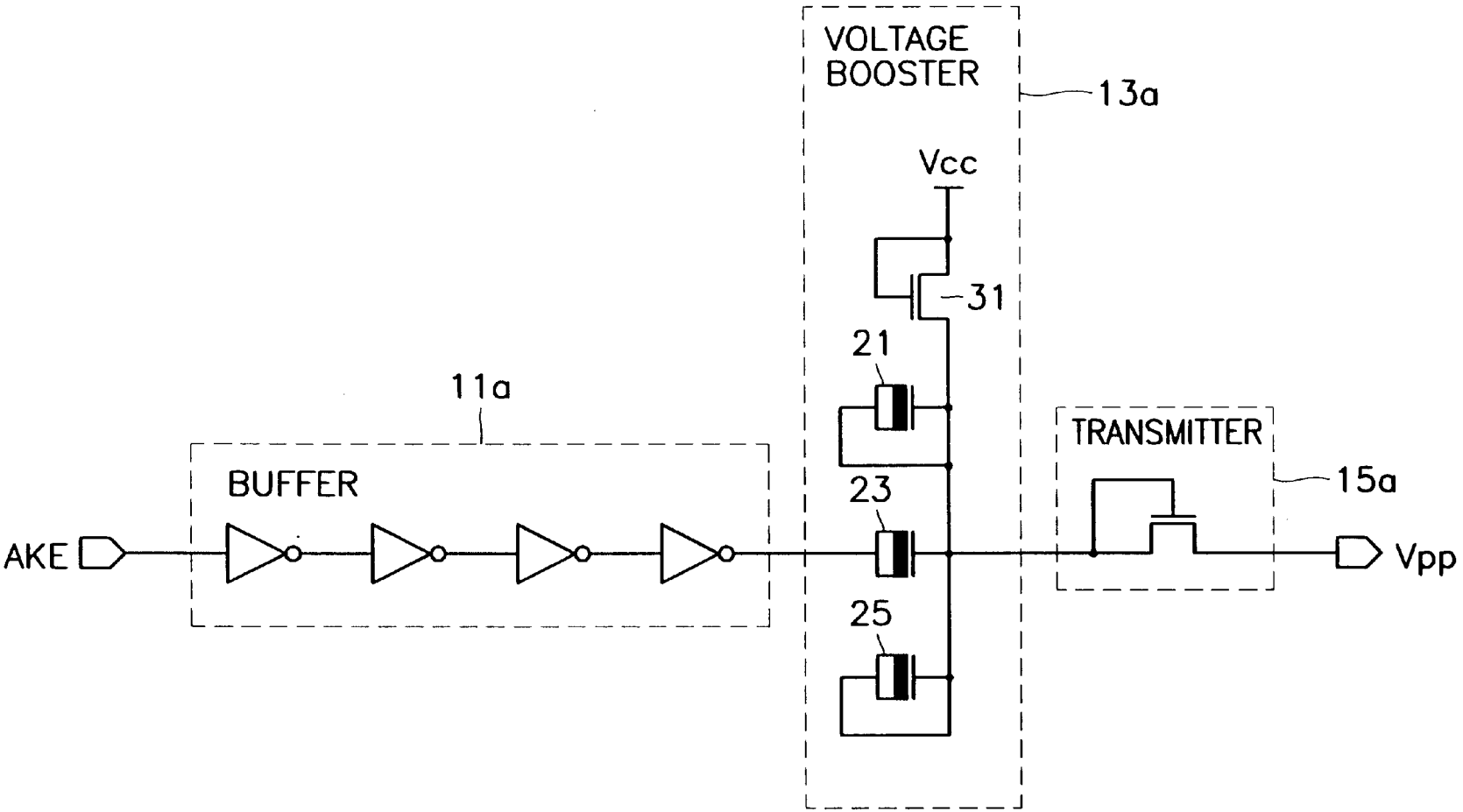
FIG. 2A (PRIOR ART)
FIGS. 2A and 2B are circuit diagrams illustrating alterations to the conventional boosting power supply circuit of FIG. 1 for increasing or reducing the charge amount of the boosted voltage.
Figure 2B:
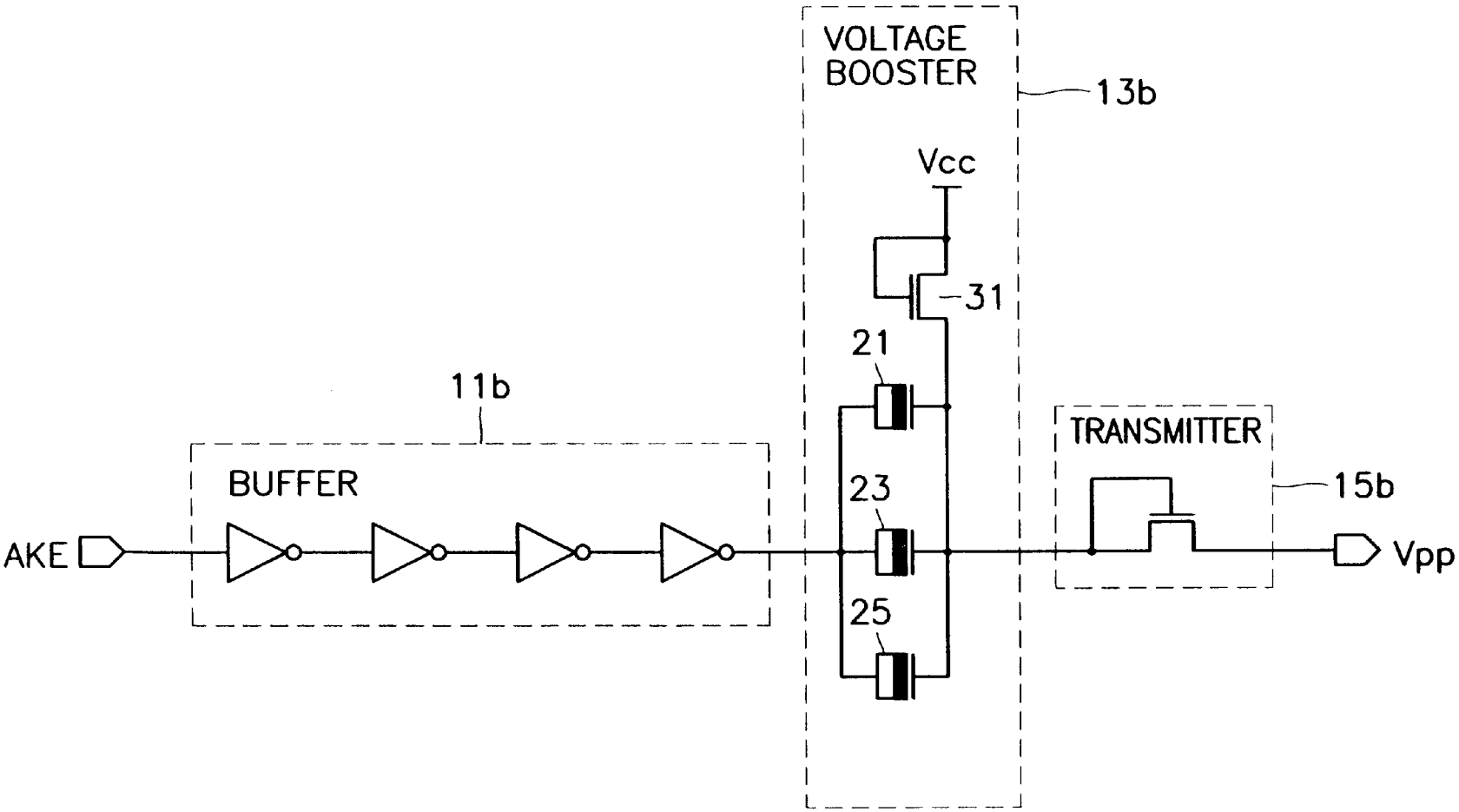
FIG. 2B (PRIOR ART)
Figure 3:
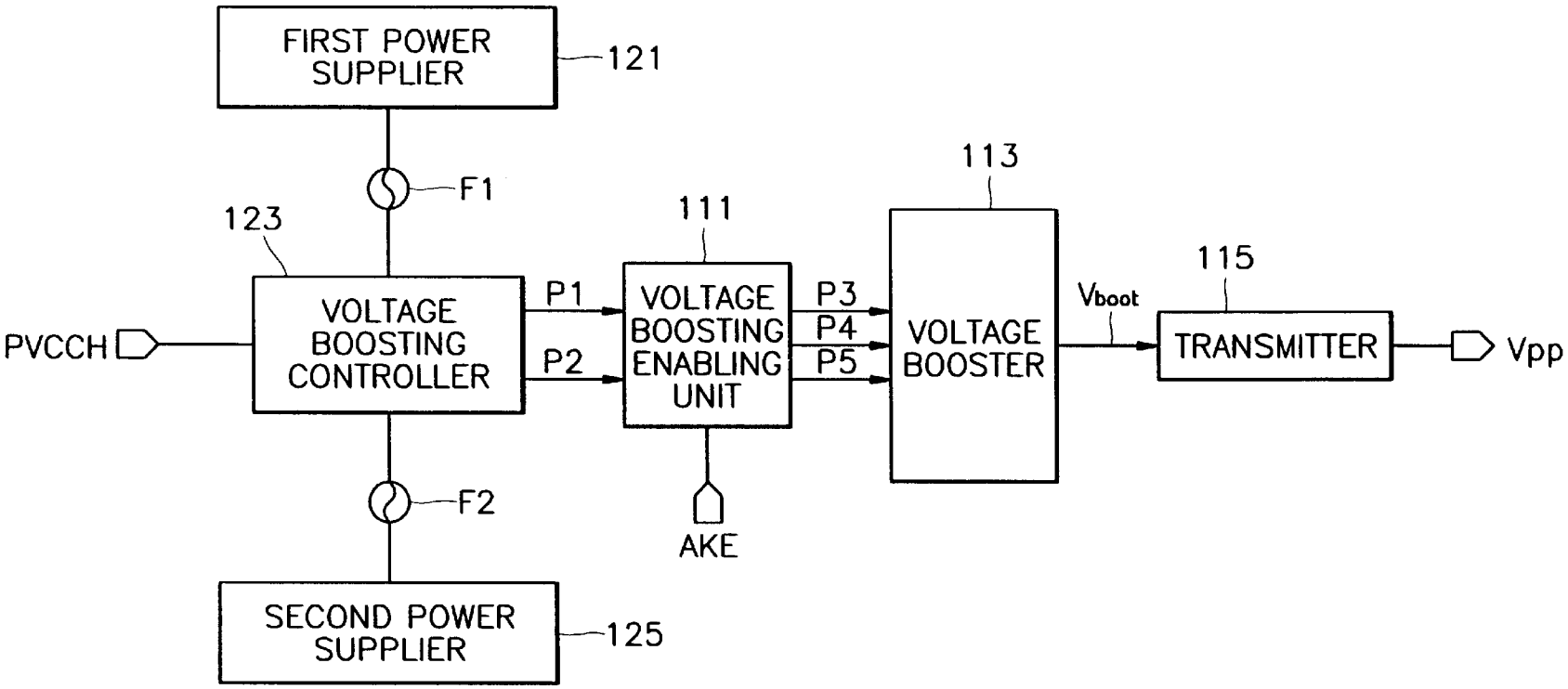
FIG. 3 is a block diagram of a voltage boosting power supply circuit of a memory integrated circuit according to the present invention.

FIG. 3 is a block diagram of a voltage boosting power supply circuit constructed according to a preferred embodiment of the present invention. The voltage boosting power supply circuit includes first and second power suppliers 121 and 125, first and second fuses F1 and F2, a voltage boosting controller 123, a voltage boosting enabling unit 111, a voltage booster 113, and a transmitter 115.

The first and second power suppliers 121 and 125 are coupled to the voltage boosting controller 123 through respective first and second fuses F1 and F2 to which a power supply voltage Vcc is applied.

The first and second fuses F1 and F2 are capable of being cut by external energy. For example, laser fuses cut by laser can be used for the first and second fuses F1 and F2. Another type of fuse that can be used in the invention, an electrical fuse, can be cut by the application of a high voltage (e.g. 27 volts) at any stage during manufacture and operation including the package stage. The laser fuse, on the other hand, is cut by a laser only in the wafer stage of manufacture.

The voltage boosting controller 123 is connected to the first and second fuses F1 and F2, and generates first and second control signals P1 and P2 responsive to a voltage boosting control signal PVCCH and output signals from the first and second fuses F1 and F2. The voltage boosting control signal PVCCH is set at a ground voltage GND, i.e., a logic low level, before power of a memory integrated circuit is turned on. The voltage boosting control signal PVCCH is then set to a logic high level after the power to the memory integrated circuit reaches the power supply voltage Vcc.

The voltage boosting enabling unit 111 generates third to fifth control signals P3, P4 and P5, responsive to a voltage boosting enable signal AKE and the first and second control signals P1 and P2.

The voltage booster 113 then generates the voltage boosting power supply Vboot, responsive to the third to fifth control signals P3, P4 and P5.

The transmitter 115 then generates the voltage boosting power supply Vpp, responsive to the voltage boosting power supply Vboot.

When the first and second fuses F1 and F2 of FIG. 3 are uncut, the first and second control signals P1 and P2 are activated. As will be shown and described in detail below, when the first and second control signals P1 and P2 are activated, the third control signal P3 is deactivated and the fourth and fifth control signals P4 and P5 are controlled by the voltage boosting enable signal AKE. That is, when the voltage boosting enable signal AKE is activated, the fourth and fifth control signals P4 and P5 are activated. When the third control signal P3 is deactivated and the fourth and fifth control signals P4 and P5 are activated, the voltage booster 113 supplies voltage boosting power supply Vboot to transmitter 115.

When the charge amount of the voltage boosting power supply Vpp consumed in an output terminal of the transmitter 115 is less than that supplied from the voltage booster 113, the charge amount of the voltage boosting power supply Vboot supplied from the voltage booster 113 is reduced such that it is equal to the charge amount of the voltage boosting power supply Vpp consumed in the output terminal of the transmitter 115. However, when charge amount of the voltage boosting power supply Vboot of the voltage booster 113 is more than that consumed in the output terminal of the transmitter 115, the reliability of the memory integrated circuit chip is reduced. In order to reduce the charge amount of the voltage boosting power supply Vboot supplied from the voltage booster 113, the fifth control signal P5 is deactivated (yielding low logic level) by cutting the second fuse F2. When the second fuse F2 is cut, the second control signal P2 is activated (yielding high logic level), which deactivates the fifth control signal P5.

When the charge amount of voltage boosting power supply Vpp consumed in the output terminal of the transmitter 115 is more than that of the voltage boosting power supply Vboot supplied from the voltage booster 113, the charge amount of the voltage boosting power supply Vboot supplied from the voltage booster 113 increases such that it is equal to the charge amount consumed in the output terminal of the transmitter 115. However, when the charge amount of the voltage boosting power supply Vboot of the voltage booster 113 is more than that consumed in the output of the transmitter 115, the memory integrated circuit chip may malfunction. In order to increase the charge amount of the voltage boosting power supply Vboot, the third control signal P3 is activated. In order to activate the third control signal P3, the first fuse F1 is cut without cutting the second fuse F2. When the first fuse F1 is cut, the first control signal P1 is activated, where the third control signal P3 is determined by an voltage boosting enable signal AKE. That is, when the voltage boosting enable signal AKE is deactivated, the third control signal P3 is deactivated.

A structure of a circuit of FIG. 3 will be in detail described with reference to FIGS. 4 to 9.

Figure 4:
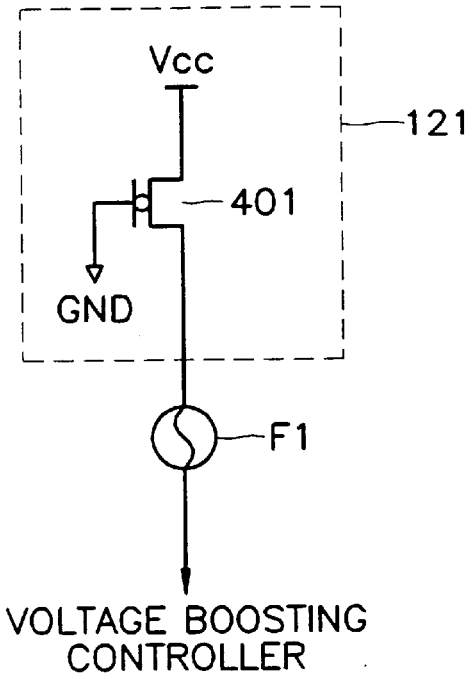
FIG. 4 shows a circuit diagram of the first power supplier and a first fuse of FIG. 3.

FIG. 4 shows a circuit diagram of the first power supplier 121 and a first fuse F1 of FIG. 3. Referring to FIG. 4, the first power supplier 121 includes a PMOS transistor 401 having a source where the power supply voltage Vcc is supplied, a gate connected to a ground terminal GND, and a drain connected to one end of the first fuse F1. The PMOS transistor 401, the gate of which is connected to the ground terminal GND, is always activated.

The first fuse F1 includes a laser fuse capable of being cut by a laser.

Figure 5:
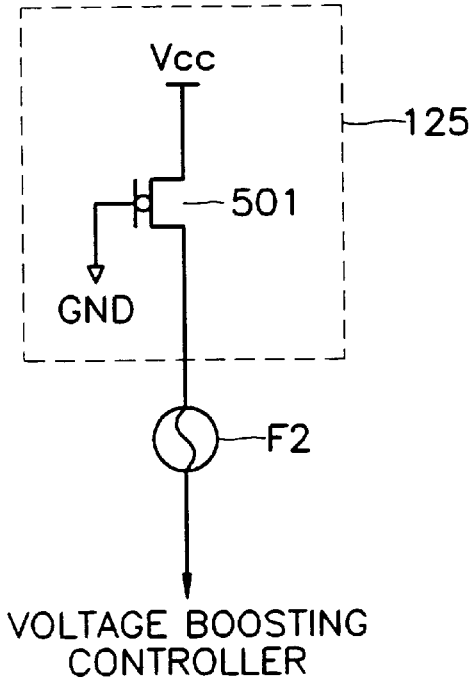
FIG. 5 shows a circuit diagram of the second power supplier and a second fuse of FIG. 3.

FIG. 5 shows a circuit diagram of the second power supplier 125 and the second fuse F2 of FIG. 3. Referring to FIG. 5, the second power supplier 125 includes a PMOS transistor 501 having a source connected to the power supply voltage Vcc, a gate connected to a ground terminal GND, and a drain connected to one end of the second fuse F2. The PMOS transistor 501, the gate of which is connected to the ground terminal GND, is always activated.

The second fuse F2 includes a laser fuse capable of being cut by a laser.

Figure 6:
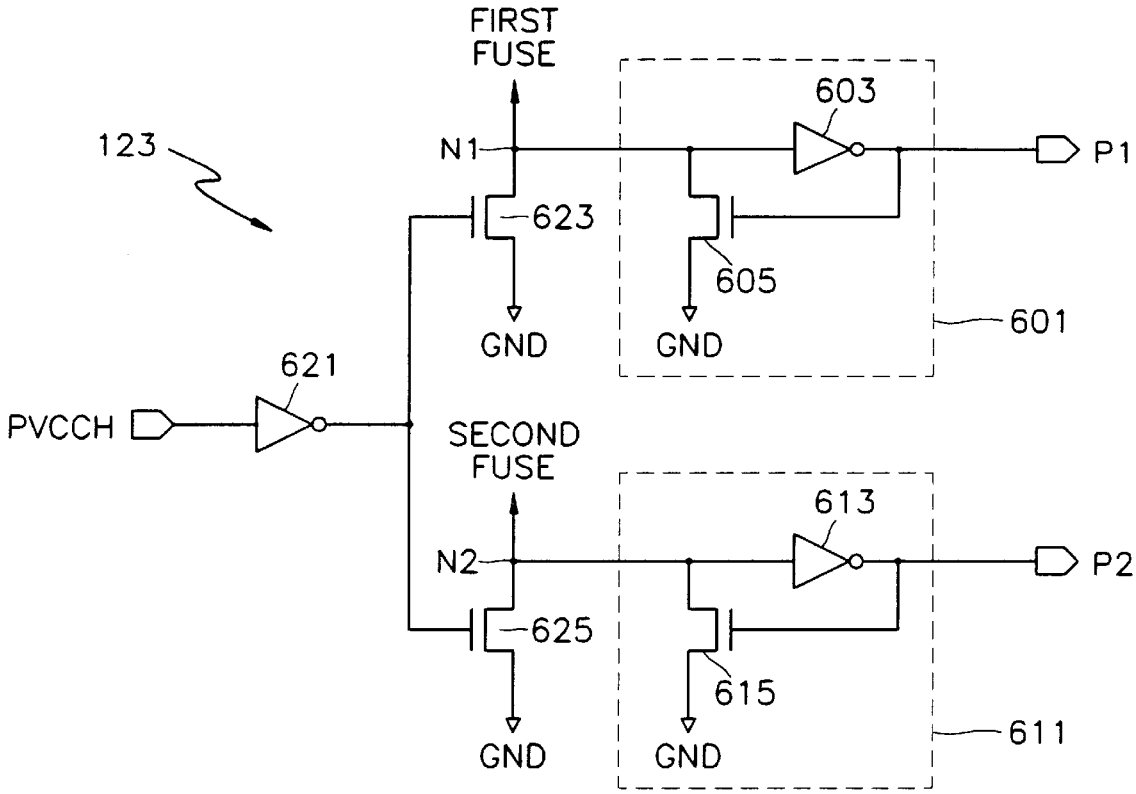
FIG. 6 is a circuit diagram of a preferred embodiment of the voltage boosting controller of FIG. 3.

FIG. 6 is a circuit diagram of the voltage boosting controller 123 of FIG. 3. Referring to FIG. 6, the voltage boosting controller 123 includes first and second latch units 601 and 611, two NMOS transistors 623 and 625, and an inverter 621.

The inverter 621 inverts a voltage boosting control signal PVCCH and outputs the inverted voltage boosting control signal PVCCH.

A drain of the NMOS transistor 623 is connected to the other end of the first fuse F1, i.e., a node N1, a gate thereof is connected to an output terminal of the inverter 621, and a source thereof is grounded. When an output signal of the inverter 621 is a logic high level, the NMOS transistor 623 is activated to reduce a voltage level of the node N1 to the ground voltage level GND, and when the output signal of the inverter 621 is a logic low level, the NMOS transistor is deactivated.

A drain of the NMOS transistor 625 is connected to the other end of the second fuse F2, i.e., a node N2, a gate thereof is connected to an output terminal of the inverter 621, and a source thereof is grounded. When an output signal of the inverter 621 is a logic high level, the NMOS transistor 625 is activated to descend a voltage level to the ground voltage level GND, and when the output signal of the inverter 621 is a logic low level, the NMOS transistor is deactivated.

The first latch unit 601 includes an inverter 603 and an NMOS transistor 605, and a voltage level of the node N1 is inverted and latched. That is, when the voltage level of the node N1 is a logic low level, a voltage of a logic high level is output, and when the voltage level of the node N1 is a logic high level, the voltage of the logic low level is output. The first control signal P1 is generated from the first latch unit 601. A drain of the NMOS transistor 605 is connected to the node N1, a gate thereof is connected to an output terminal of the inverter 603, and a source is connected to the ground terminal GND. When the output signal of the inverter 603 is a logic high level, the NMOS transistor 605 is activated, to thereby maintain the node N1 at the ground voltage level GND. When the output signal of the inverter 603 is a logic low level, the NMOS transistor is deactivated to thereby maintain the current voltage of the node N1.

The second latch unit 611 including an inverter 613 and an NMOS transistor 615, inverts and latches a voltage of the node N2. That is, when the voltage of the node N2 is a logic low level, the voltage of a logic high level is output, and when the voltage of the node N2 is a logic high level, the voltage of a logic low level is output. The second control signal P2 is generated from the second latch unit 611. The inverter 613 inverts the voltage of the node N2 to output the inverted voltage of the node N2 as the second control signal P2. A drain of the NMOS transistor 615 is connected to the node N2, the gate thereof is connected to an output terminal of the inverter 613, and a source thereof is connected to a ground terminal GND. When the output signal of the inverter 613 is logic high level, the NMOS transistor 615 is activated, to thereby maintain the node N2 at the ground voltage level GND. When the output signal of the inverter 613 is logic low level, the NMOS transistor 615 is deactivated, to thereby maintain the voltage of the node N2.

Figure 7:
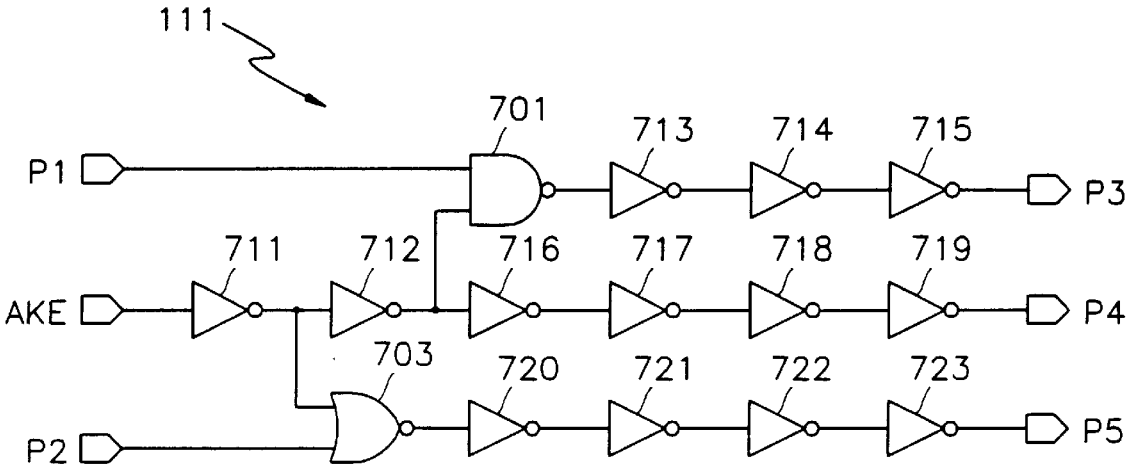
FIG. 7 is a circuit diagram of a preferred embodiment of the voltage boosting enabling unit of FIG. 3.

FIG. 7 is a circuit diagram of the voltage boosting enabling unit 111 of FIG. 3. Referring to FIG. 7, the voltage boosting enabling unit 111 includes first to thirteenth inverters 711 to 723, an NAND gate 701 and an NOR gate 703.

The first inverter 711 inverts a voltage boosting enable signal AKE.

The second inverter 712 inverts an output of the first inverter 711.

When either the first control signal P1 or the output signal of the inverter 712 is logic low, the output signal of the NAND gate 701 becomes logic high. When both the first control signal P1 and the output signal of the inverter 712 are logic high, the output signal of the NAND gate 701 becomes logic low.

The third inverter 713 inverts the output of the NAND gate 701.

When either the second control signal P2 or the output signal of the first inverter 711 is logic high, the output signal of the NOR gate 703 becomes logic low. When both the second control signal P2 and the output signal of the first inverter 711 are logic low, the output signal of the NOR gate 703 becomes logic high.

The fourth and fifth inverters 714 and 715 buffer the output signal of the third inverter 713 and generate the third control signal P3.

The sixth to ninth inverters 716 to 719 buffer an output signal of the second inverter 712 and generate the fourth control signal P4.

The tenth to thirteenth inverters 720 to 723 buffer an output signal of the NOR gate 703 and generate the fifth control signal P5.

Figure 8:
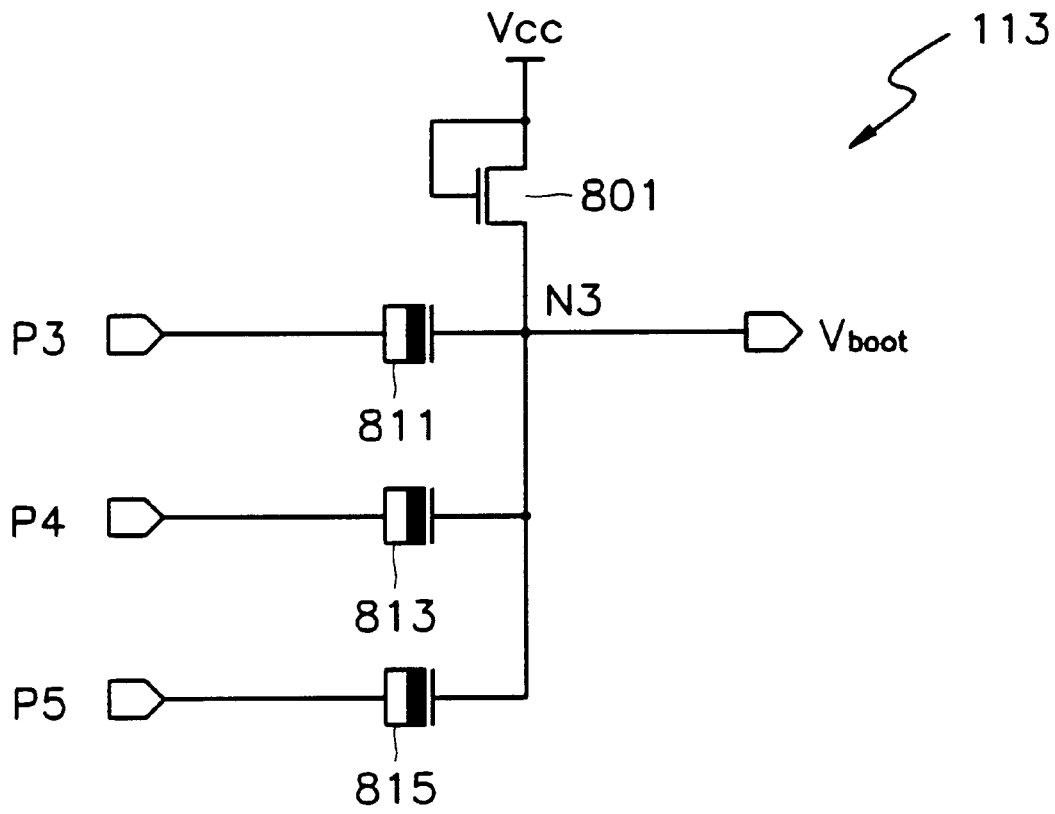
FIG. 8 is a circuit diagram of a preferred embodiment of the voltage booster of FIG. 3.

FIG. 8 is a circuit diagram of the voltage booster 113 of FIG. 3. Referring to FIG. 8, the voltage booster 113 includes one NMOS transistor 801 and three capacitors 811, 813 and 815.

A power supply voltage Vcc is applied to a drain and a gate of the NMOS transistor 801, and a source of the NMOS transistor 801 is in common connected to each output of three capacitors 811, 813 and 815. Accordingly, when the NMOS transistor 801 is activated, the power supply voltage Vcc is supplied to output terminals of the three capacitors 811, 813 and 815.

The capacitor 811 responds to the third control signal P3. That is, when the third control signal P3 is active by logic high, the capacitor 811 is charged, and when the third control signal P3 is inactive by logic low, the capacitor 811 is discharged.

The capacitor 813 responds to the fourth control signal P4. That is, when the fourth control signal P4 is active by logic high, the capacitor 813 is charged, and when the fourth control signal P4 (e.g. the AKE signal) is inactive by logic low, the capacitor 813 is discharged.

The capacitor 815 responds to the fifth control signal P5. That is, when the fifth control signal P5 is active by logic high, the capacitor 815 is charged, and when the fifth control signal is inactive by logic low, the capacitor 815 is discharged.

A level of the voltage boosting power supply Vboot generated from the voltage booster 113 is changed by logic levels of the third to fifth control signals P3, P4 and P5. That is, when at least one of the third to fifth control signals P3, P4 and P5 is logic high, one of the third capacitors 811, 813 and 815 is charged. A level of the voltage boosting power supply Vboot is expressed as Formula 1:

$$Vpp=2\ Vcc-Vtn, \qquad \text{(Formula 1)}$$

where reference character Vtn indicates a threshold voltage of the NMOS transistor 801.

The charge amount of the voltage boosting power supply Vboot is changed by logic levels of the third to fifth control signals P3, P4 and P5.

When the fourth control signal P4 and the fifth control signal P5 are active by logic high, the voltage boosting power supply Vboot has predetermined charge amount Q4 as in Formula 2:

$$Q4=(C813+C815)\times Vcc, \qquad \text{(Formula 2)}$$

where reference character C813 indicates capacitance of the capacitor 813, and reference character C815 indicates capacitance of the capacitor 815.

When the fourth control signal P4 is active by logic high, the charge amount Q5 of the voltage boosting power supply Vboot is less than the charge amount Q4 as in Formula 3:

$$Q5=C813\times Vcc. \qquad \text{(Formula 3)}$$

If the third to fifth control signals P3, P4 and P5 are active by logic high, the charge amount Q6 of the voltage boosting power supply Vboot is more than the charge amount Q4 as in Formula 4:

$$Q6=(C811+C813+C815)\times Vcc, \quad \text{(Formula 4)}$$

where reference character C811 indicates capacitance of the capacitor 811.

Figure 9:
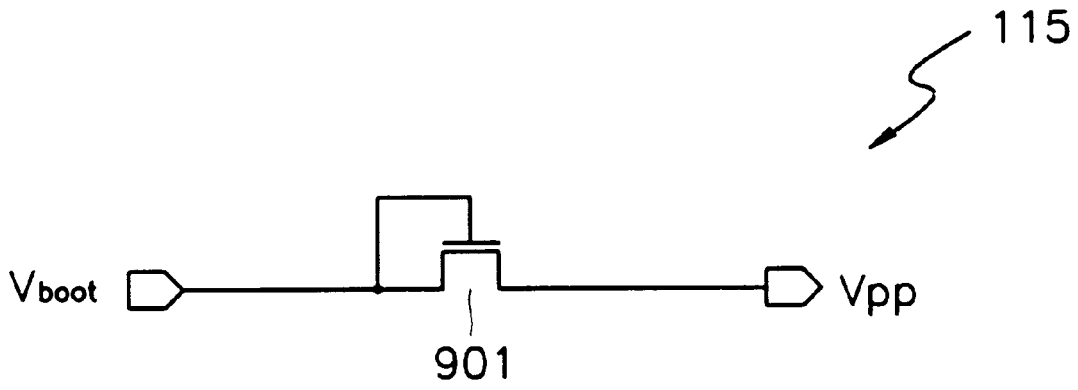
FIG. 9 is a circuit diagram of a preferred embodiment of the transmitter of FIG. 3.

FIG. 9 is a circuit diagram of the transmitter 115 of FIG. 3. Referring to FIG. 9, the transmitter 115 includes an NMOS transistor 901 having a gate and a drain connected to an output terminal of the voltage booster 113 of FIG. 8, and a source where the voltage boosting power supply is generated. When the voltage boosting power supply Vpp is generated from the voltage booster 113, the transmitter 115 transmits the voltage boosting power supply Vboot to a load (not shown) connected to an output terminal of the transmitter 115.

An operation of the voltage boosting power supply circuit of FIG. 3 will be described with reference to FIGS. 4 to 9.

First, in the case when first and second fuses F1 and F2 are not cut, each of the power supply voltages Vcc of the first and second power suppliers 121 and 125 is applied to each of the input terminals of first and second latch units 601 and 611, i.e., nodes. Since the input terminal of the first latch unit 601 is logic high, the output of the first latch unit 601, i.e., the first control signal P1, becomes logic low. Accordingly, the output of the NAND gate 701 is maintained by a logic high level. The output of the NAND gate 701 of a logic high level is inverted during passing through the third to fifth inverters 713, 714 and 715. Accordingly, the third control signal P3 becomes logic low. When the third control signal P3 is logic low, charge is not stored in the capacitor 811, so that an output voltage of the capacitor 811 becomes zero.

When a power supply voltage Vcc of the second power supplier 125 is applied to an input terminal of the second latch unit 611, an output of the second latch unit 611, i.e., the second control signal P2, is maintained by a logic low level. When the output of the second latch unit 611 is logic low, an output of the NOR gate 703 is determined by a logic level of the output of the first inverter 711. When the voltage boosting control signal AKE is activated by a logic high level, the output of the first inverter 711 becomes a logic low level. Accordingly, the output of the NOR gate 703 becomes a logic high level. A phase of the output of the NOR gate 703 of a logic high level is not changed during passing through the tenth to thirteenth inverters 720 to 723. Accordingly, since the fifth control signal P5 is active by logic high, charge is stored in the capacitor 815, so that a level of the output of the capacitor 815 becomes the level of the power supply voltage Vcc.

When the voltage boosting control signal AKE is active, a phase of the voltage boosting control signal AKE is not changed during passing through the inverters 711, 712, 716, 717, 718 and 719. Therefore, since the fourth control signal P4 is active by logic high, charge is stored in the capacitor 813. When the charge is stored in the capacitor 813, a level of the output terminal of the capacitor 813 becomes a power supply voltage level.

However, a voltage (Vcc−Vtn) generated by the NMOS transistor 801 is applied to a node N3. Accordingly, the voltage boosting power supply Vpp is expressed as in the above Formula 1.

Here, charge amount of the voltage boosting power supply Vpp is expressed as in the above Formula 2.

Then, in the case that the second fuse F2 is cut and the first fuse F1 is not cut, an operation of the voltage boosting power supply circuit will be described as follows. When the first fuse F1 is not cut, the third control signal P3 is inactive and thus charge is not stored in the capacitor 811. Accordingly, a voltage of an output terminal of the capacitor 811 becomes zero. When the second fuse F2 is cut, an input terminal of the second latch unit 611 is floated, and thus the output of the second latch unit 611 is not exactly shown. When the power is turned on, the voltage boosting control signal PVCCH is initially zero, to activate the NMOS transistor 625. When the NMOS transistor 625 is activated, a voltage of the node N2 becomes a ground voltage level GND, so that the output of the second latch unit 611 becomes a logic high level. Since the output of the second latch unit 611 becomes logic high, and then the voltage boosting control signal PVCCH becomes logic high, the NMOS transistor 625 is deactivated. However, the output of the second latch unit 611 is maintained by a logic high level. When the output of the second latch unit 611 becomes logic high, the NOR gate 703 generates an output signal of a logic low level regardless of the output of the first inverter 711. When the output of the NOR gate 703 becomes a logic low level, the fifth control signal P5 is inactive. Accordingly, since charge is not stored in the capacitor 815, the charge amount of the voltage boosting power supply Vboot is reduced as expressed in the above Formula 3.

Then, in the case that the first and second fuses F1 and F2 are cut, an operation of the voltage boosting power supply circuit will be described as follows. When the second fuse F2 is cut, the fifth control signal P5 is inactive, and thus charge is not stored in the capacitor 815. Accordingly, an output terminal voltage of the capacitor 815 becomes zero. When the first fuse F1 is cut, an input terminal of the first latch unit 601 is floated. Accordingly, the output of the first latch unit 601 is not exactly shown. However, when the power is turned on, an initial voltage of the voltage boosting control signal PVCCH is zero. Accordingly, the NMOS transistor 623 is activated. At this time, the node N1 becomes a ground voltage level GND, so that the output of the first latch unit 601 is maintained by a logic high level. When the output of the first latch unit 601 becomes logic high, the voltage boosting control signal PVCCH becomes logic high, so that the NMOS transistor 623 is deactivated. At this time, the output of the first latch unit 623 is maintained by a logic high level. When the output of the first latch unit 601 becomes logic high, an output of the NAND gate 701 is determined by an output of the second inverter 712. When the voltage boosting control signal AKE is active by a logic high level, the output of the second inverter 712 becomes logic high. Accordingly, the output of the NAND gate 701 becomes logic low. When the output of the NAND gate 701 becomes logic low, the third control signal P3 is active by a logic high level. Accordingly, since charge is stored in the capacitor 811, charge amount of the voltage boosting power supply Vboot increases as in the above Formula 4.

Figure 10:
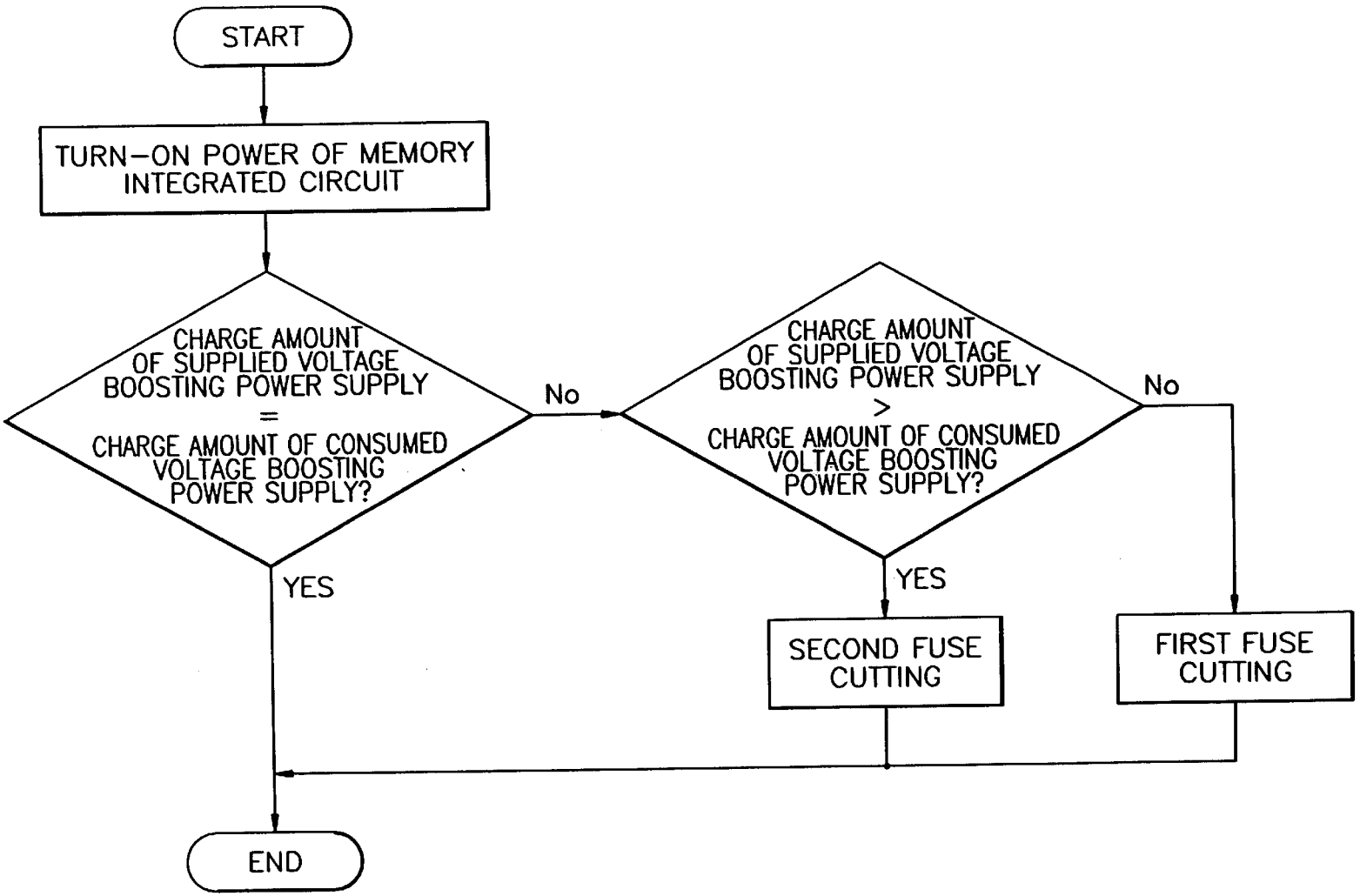
FIG. 10 is a flowchart illustrating the preferred method for controlling charge amount of a voltage boosting power supply according to the present invention.

FIG. 10 is a flowchart for illustrating a method for controlling charge amount of a voltage boosting power supply according to the present invention. Referring to FIGS. 3 and 10, in order to check the charge amount of the voltage boosting power supply Vboot supplied from the voltage booster 113, power of the memory integrated circuit is turned on. Then, the charge amount of the voltage boosting power supply supplied from the voltage booster 113 is compared to that consumed in a load (not shown) connected to an output terminal of the transmitter 115. At this time, when the charge amount of the voltage boosting power supply supplied from the voltage booster 113 is less than that consumed in the load, the first fuse F1 is cut, to thereby increase the charge amount of the supplied voltage boosting power supply, and when the charge amount of the supplied voltage boosting power supply is more than that consumed in the load (not shown), the second fuse F2 is cut, to thereby reduce the charge amount of the supplied voltage boosting power supply. If the charge amount of the supplied voltage boosting power supply is equal to the charge amount of the supplied voltage boosting power supply, the first and second fuses F1 and F2 are not cut.

As described above, the voltage boosting power supply circuit according to the present invention includes fuses F1 and F2, which can be cut using a laser, to thereby easily control the charge amount of the voltage boosting power supply. Therefore, it is not necessary to re-perform a masking process and a metal process, to thereby reduce the production cost of the integrated circuit chip, and development of the integrated circuit chip is not delayed.

It should be understood that the invention is not limited to the illustrated embodiment and that many changes and modifications can be made within the scope of the invention by a person skilled in the art.

I claim:

1. A voltage boosting power supply circuit of a memory integrated circuit comprising:

a first power supplier;

a first fuse connected at one end to the first power supplier;

a second power supplier;

a second fuse connected at one end to the second power supplier;

a voltage boosting controller connected to other ends of the first and second fuses for generating first and second logic control signals responsive to first and second power signals received from the respective first and second fuses;

a voltage boosting enabling circuit for receiving the first and second logic control signals from the voltage boosting controller and outputting third, fourth and fifth logic control signals responsive to the first and second logic control signals and a voltage boosting enable signal, wherein said first fuse is interposed between the first power supplier and the voltage boosting enabling circuit and the second fuse is interposed between the second power supplier and the voltage boosting enabling circuit wherein the first and second fuses, voltage boosting controller, and first and second power suppliers are connected in series; and a voltage booster for varying a supplied charge from the voltage boosting power supply circuit by an amount responsive to a logic level of the third and fifth control signals.

2. The voltage boosting power supply circuit of claim 1, wherein the voltage boosting enabling circuit includes means for outputting a low logic signal as the third logic control signal when the first fuse is uncut.

3. The voltage boosting power supply circuit of claim 1, wherein the voltage boosting enabling circuit includes means for outputting a low logic signal as the fifth logic control signal when the second fuse is cut.

4. The voltage boosting power supply circuit of claim 1, wherein the first power supplier is a PMOS transistor having a source connected to a power supply, a gate connected to a ground voltage, and a drain connected to the one end of the first fuse.

5. The voltage boosting power supply circuit of claim 1, wherein the second power supplier is a PMOS transistor having a source connected to a power supply, a gate where a ground voltage is applied, and a drain connected to one end of the second fuse.

6. The voltage boosting power supply circuit of claim 1, wherein the first fuse is a laser fuse capable of being cut by laser.

7. The voltage boosting power supply circuit of claim 1, wherein the second fuse is a laser fuse cut by laser.

8. The voltage boosting power supply circuit of claim 1, wherein the voltage boosting controller comprises:

an inverter for inverting a voltage boosting control signal;

a first NMOS transistor having a gate connected to an output terminal of the inverter, a drain connected to the other end of the first fuse, and a grounded source;

a first latch unit connected to a drain of the first NMOS transistor, for inverting and latching a signal generated from the drain of the first NMOS transistor and outputting the latched signal as the first logic control signal;

a second NMOS transistor having a gate connected to an output terminal of the inverter, a drain connected to the other end of the second fuse, and a grounded source; and a second latch unit connected to the drain of the second NMOS transistor, for inverting and latching the signal generated from the drain of the second NMOS transistor and generating the latched signal as the second logic control signal.

9. The voltage boosting power supply circuit of claim 8, wherein the first latch unit comprises:

an inverter for inverting a signal generated from the drain of the first NMOS transistor; and an NMOS transistor having a drain connected to an input terminal of the inverter, a gate connected to an output terminal of the inverter, and a grounded source.

10. The voltage boosting power supply circuit of claim 8, wherein the second latch unit comprises:

an inverter for inverting a signal generated from the drain of the second NMOS transistor; and an NMOS transistor having a drain connected to an input terminal of the inverter, a gate connected to the output terminal of the inverter, and a grounded source.

11. The voltage boosting power supply circuit of claim 1, wherein the voltage boosting enabling unit comprises:

a first inverter for inverting the voltage boosting enable signal;

a second inverter for inverting an output signal of the first inverter;

an NAND gate for NAND-operating the first logic control signal by an output signal of the second inverter;

a first inverter chain for buffering an output signal of the NAND gate and generating the third logic control signal;

a second inverter chain for buffering the output signal of the second inverter and generating the fourth logic control signal;

an NOR gate for NOR-operating the second control signal and an output signal of the first inverter;

a third inverter chain for buffering an output signal of the NOR gate and generating the fifth logic control signal.

12. The voltage boosting power supply circuit of claim 11, wherein the first inverter chain includes an odd number of inverters connected in series.

13. The voltage boosting power supply circuit of claim 11, wherein the second and third inverter chains include an equal number of inverters connected in series.

14. The voltage boosting power supply circuit of claim 11, wherein the second and third inverter chains include an even number of inverters connected in series.

15. The voltage boosting power supply circuit of claim 1, wherein the voltage booster comprises:

an NMOS transistor having a drain and a gate connected to a power supply;

a first capacitor connected between the third control signal and the source of the NMOS transistor;

a second capacitor connected between the fourth control signal and the source of the NMOS transistor; and a third capacitor connected between the fifth control signal and the source of the NMOS transistor, and wherein the voltage boosting power supply is generated from the source of the NMOS transistor.

16. The voltage boosting power supply circuit of claim 1, further comprising a transmitter connected to an output terminal of the voltage booster, for transmitting a voltage boosting power supply from the voltage boosting power supply circuit.

17. A method for controlling charge amount of a voltage boosting power supply of a memory integrated circuit having first and second fuses, a voltage booster connected to the first and second fuses for supplying a voltage boosting power supply, and a load connected to the voltage booster for consuming charge of the voltage boosting power supply, wherein supplied charge amount of the voltage boosting power supply increases when the first fuse is cut, and the supplied charge amount of the voltage boosting power supply is reduced when the second fuse is cut, the method comprising the steps of:

turning on power of the memory integrated circuit;

comparing the supplied charge amount of the voltage boosting power supply to that of the consumed voltage boosting power supply; and cutting the first fuse when the supplied charge amount of the voltage boosting power supply supplied by the voltage boosting power supply is less than the consumed charge amount of the voltage boosting power supply consumed by the voltage boosting power supply, and cutting the second fuse when the supplied charge amount of the voltage boosting power supply is more than the consumed charge amount of the voltage boosting power supply.

18. The method of claim 17, wherein the first and second fuses are cut using a laser.

19. The method of claim 17, wherein the supplied charge amount of the voltage boosting power supply from the voltage booster increases when a number of operating capacitors of the voltage booster is more than a predetermined number of capacitors, and the supplied charge amount thereof is reduced when the number of operating capacitors of the voltage booster is less than the predetermined number of capacitors.

20. A voltage boosting power supply circuit of a memory integrated circuit comprising:

a first power supplier;

a first fuse connected at one end to the first power supplier;

a second power supplier;

a second fuse connected at one end to the second power supplier;

a voltage boosting controller connected to other ends of the first and second fuses for generating first and second logic control signals responsive to first and second power signals received from the respective first and second fuses;

a voltage boosting enabling circuit for receiving the first and second logic control signals from the voltage boosting controller and outputting third, fourth and fifth logic control signals responsive to the first and second logic control signals and a voltage boosting enable signal; and a voltage booster for varying a supplied charge amount of the voltage boosting power supply circuit by an amount responsive to a logic level of the third and fifth control signals, wherein the voltage booster comprises:

an NMOS transistor having a drain and a gate connected to a power supply;

a first capacitor connected between the third control signal and the source of the NMOS transistor;

a second capacitor connected between the fourth control signal and the source of the NMOS transistor; and a third capacitor connected between the fifth control signal and the source of the NMOS transistor, and wherein the voltage boosting power supply is generated from the source of the NMOS transistor.

* * * * *

UNITED STATES PATENT AND TRADEMARK OFFICE

CERTIFICATE OF CORRECTION

PATENT NO. : 6,060,942
DATED : May 9, 2000
INVENTOR(S) : Oh

It is certified that error appears in the above-identified patent and that said Letters Patent is hereby corrected as shown below:

Column 3,
Line 9, "(e.g. 27 volts)" should read -- (e.g. ≥7 volts) --.

Signed and Sealed this

Third Day of December, 2002

JAMES E. ROGAN
*Director of the United States Patent and Trademark Office*